US011506439B2

(12) United States Patent
Kim

(10) Patent No.: US 11,506,439 B2
(45) Date of Patent: Nov. 22, 2022

(54) SYSTEM AND METHOD FOR CONTROLLING ICE-MAKING AND ICE-SEPARATING OF ICE MAKER

(71) Applicant: DAEYEONG E&B Co., Ltd., Gyeonggi-do (KR)

(72) Inventor: Doo Ha Kim, Incheon (KR)

(73) Assignee: BLUENIX CO., LTD, Gyeonggi-Do (KR)

( * ) Notice: Subject to any disclaimer, the term of this patent is extended or adjusted under 35 U.S.C. 154(b) by 114 days.

(21) Appl. No.: 17/003,811

(22) Filed: Aug. 26, 2020

(65) Prior Publication Data

US 2021/0318053 A1 Oct. 14, 2021

(30) Foreign Application Priority Data

Apr. 8, 2020 (KR) ..... 10-2020-0042892

(51) Int. Cl.
*F25C 5/20* (2018.01)

(52) U.S. Cl.
CPC ..... *F25C 5/20* (2018.01); *F25C 2600/02* (2013.01); *F25C 2600/04* (2013.01); *F25C 2700/14* (2013.01)

(58) Field of Classification Search
CPC .... F25C 5/20; F25C 2600/02; F25C 2600/04; F25C 2700/14; F25C 5/10; F25C 1/12; F25C 2700/12
See application file for complete search history.

(56) References Cited

U.S. PATENT DOCUMENTS

2016/0334157 A1* 11/2016 Broadbent ..... F25C 5/10

FOREIGN PATENT DOCUMENTS

| | | | | |
|---|---|---|---|---|
| JP | H0510641 A | | 1/1993 | |
| KR | 20090096789 A | * | 9/2009 | ..... F25C 1/246 |
| KR | 20120111374 A | | 10/2012 | |
| KR | 20130008760 A | | 1/2013 | |
| KR | 20150115988 A | | 10/2015 | |
| KR | 201400777089 A | | 1/2016 | |
| KR | 20180066451 A | * | 6/2018 | |
| KR | 20180066451 A | | 6/2018 | |

* cited by examiner

*Primary Examiner* — Cassey D Bauer
*Assistant Examiner* — Birhanu Damtew Weldetensi
(74) *Attorney, Agent, or Firm* — Dickinson Wright PLLC

(57) ABSTRACT

A system and method for controlling ice-making and ice-separating of an ice maker is proposed. In the ice maker that is configured to change an ice-separating time so that ice is cleanly separated in accordance with a changed required icing when the required icing time is changed, the system and method count a consumed ice-making time when ice-making is performed, set a target ice-separating time longer than a predetermined reference ice-separating time when the consumed ice-making time is out of a reference time range, and control the ice maker to perform ice-separating for the set target ice-separating time by means of the controller.

6 Claims, 3 Drawing Sheets

SYSTEM AND METHOD FOR CONTROLLING ICE-MAKING AND ICE-SEPARATING OF ICE MAKER

RELATED APPLICATIONS

The present application claims priority to Korean Patent Application No. 10-2020-0042892, filed Apr. 8, 2020, the entire contents of which is incorporated herein for all purposes by this reference.

FIELD

The present disclosure relates to a system and method for controlling ice-making and ice-separating of an ice maker, the system and method changing an ice-separating time so that ice is cleanly separated in accordance with a changed required ice-making time when the required ice-making time is changed.

BACKGROUND

An ice maker is a device that makes ice.

According to the process of making ice in an ice maker, when water for making ice flows into a water tank in the ice maker through a water inlet valve, water remaining after filling the water tank is discharged through an overflow pipe and ice is made as much as the amount of the water in the water tank. That is, the amount of water in the water tank is the same as the amount of water for making ice once.

When the water tank is filled with water, a water pump operates and sends the water to an evaporator. In this process, a refrigeration cycle is also performed, so a cold refrigerant is supplied to the evaporator, whereby the evaporator is cooled and ice starts to be made by heat exchange with the water flowing down on the evaporator.

As ice is made and grown, the water level in the water tank decreases, and when the water level in the water tank reaches a predetermined water level, it is determined that ice-making is finished. Accordingly, ice-making is finished and an ice-separating process is entered.

When the ice-separating process is performed, high-temperature and high-pressure refrigerant discharged from a compressor is supplied to the evaporator by a hot-gas valve, so the temperature of the evaporator increases and the surface of the ice that is in contact with the surface of the evaporator starts to melt.

In the ice-separating process, temperature is detected by a temperature sensor attached to an evaporator outlet pipe, and when a predetermined time passes after the detected temperature reaches a predetermined level, it is determined that the ice-separating process is finished and the ice-making process is entered again.

Commercial ice makers are classified into a continuous type and a batch type, depending on the method of making ice.

A batch type ice maker makes ice while repeating the ice-making process and the ice-separating process described above and the ice-making ability thereof considerably depends on the ice-making time/ice-separating time.

That is, it is possible to determine that the more quickly the ice is made and the more quickly and cleanly the made ice is separated, the more excellent the ice-separating ability.

As described above, the ice-making time and the ice-separating time significantly influence the ice-making ability of ice makers and are considerably influenced by the surrounding temperature.

That is, the lower the surrounding temperature, the shorter the ice-making time but the longer the ice-separating time; however, the higher the surrounding temperature, the longer the ice-making time but the shorter the ice-separating time.

If ice is not completely removed from the evaporator in the ice-separating process, new ice is made on the remaining ice in the next ice-making process, so a relatively large piece of ice is made and is not cleanly removed in the next ice-separating process, which cause malfunction of an ice maker.

Accordingly, a technology of controlling an ice-separating process on the basis of a set level of a temperature sensor and a set delay time to cleanly remove ice has been proposed, but we have discovered that there is a defect in the technology that it is impossible to appropriately cope with a change of the surrounding temperature.

That is, a predetermined level of a temperature sensor and a delay time can be set on the assumption of a severe surrounding environment, but we have discovered that there is a problem in this case that when the surrounding temperature increases, additional time is unnecessarily consumed even after ice-separating is finished, which causes unnecessary energy consumption.

On the other hand, when water is supplied to an ice maker, water remaining after a water tank is filled with the water is discharged through an overflow pipe. However, if an exhaust line is clogged or a water inlet valve is broken or is not closed due to dust in the ice-making process, excessive water is supplied to the water tank.

Even in this case, ice-making is performed until the water in the water tank reaches a low level, so ice is abnormally grown and the large piece of ice is not cleanly separated for a normal ice-separating time.

The description provided above as a related art of the present disclosure is just for helping understanding the background of the present disclosure and should not be construed as being included in the related art known by those skilled in the art.

BRIEF SUMMARY

The present disclosure has been made in an effort to solve the problems described above and an objective of the present disclosure is to provide a system and method of controlling ice-making and ice-separating of an ice maker to cleanly separate ice by changing an ice-separating time in accordance with a changed consumed ice-making time when the required ice-making time is changed.

According to an aspect of the present disclosure, a method of controlling ice-making and ice-separating of an ice maker includes: an ice-making time counting process of counting a consumed ice-making time when ice-making is performed, by means of a controller; an ice-separating time setting process of setting a target ice-separating time longer than a predetermined reference ice-separating time when the consumed ice-making time is out of a reference time range by means of the controller; and an ice-separating control process of controlling the ice maker to perform ice-separating for the set target ice-separating time by means of the controller.

According to another aspect of the present disclosure, a method of controlling ice-making and ice-separating of an ice maker includes: an ice-making time counting process of counting a consumed ice-making time when ice-making is performed, by means of a controller; a first ice-separating time setting process of setting a target ice-separating time as a first ice-separating time that is longer than a predetermined reference ice-separating time when the consumed ice-making time is less than a minimum reference time by means of the controller; and an ice-separating control process of controlling the ice maker to perform ice-separating for the set target ice-separating time by means of the controller.

The method may further include a second ice-separating time setting process of setting the target ice-separating time as a second ice-separating time that is longer than the predetermined reference ice-separating time when the consumed ice-making time is a maximum reference time or more.

The first ice-separating time and the second ice-separating time may be the same.

When a case in which the consumed ice-making time is the maximum reference time or more occurs continuously two or more times, a malfunction signal of the ice maker may be output.

When the consumed ice-making time is in the reference time range, the target ice-separating time may be set as the reference ice-separating time.

According to another aspect of the present disclosure, a system for controlling ice-making and ice-separating of an ice maker includes: an ice-making time counter counting a consumed ice-making time when ice-making is performed; an ice-separating time setter setting a target ice-separating time longer than a predetermined reference ice-separating time when the consumed ice-making time is out of a reference time range; and an operation controller controlling the ice maker to perform ice-separating for the set target ice-separating time.

According to the present disclosure, there is an effect that when the consumed ice-making time is relatively short or long, the ice-separating time is changed to be long in accordance with the changed consumed ice-making time, whereby ice is cleanly separated and malfunction of the ice maker is prevented.

BRIEF DESCRIPTION OF THE DRAWINGS

The above and other objects, features and other advantages of the present disclosure will be more cleanly understood from the following detailed description when taken in conjunction with the accompanying drawings, in which.

DETAILED DESCRIPTION

Figure 1:
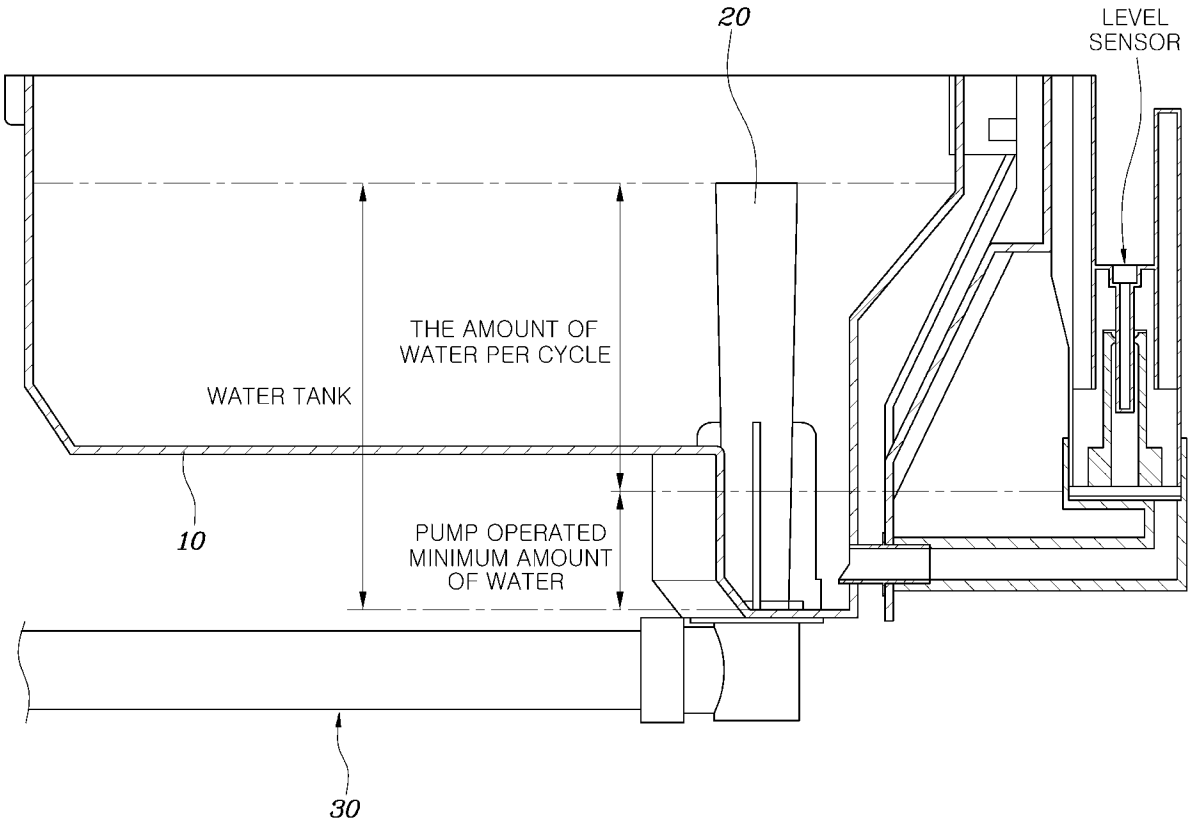
FIG. 1 is a view showing a cross-sectional structure of a water tank of an ice maker that can be applied to the present disclosure.

Exemplary embodiments of the present disclosure are described hereafter in detail with reference to the accompanying drawings.

In the following description, the structural or functional description specified to exemplary embodiments according to the concept of the present disclosure is intended to describe the exemplary embodiments, so it should be understood that the present disclosure may be variously embodied, without being limited to the exemplary embodiments.

Embodiments described herein may be changed in various ways and various shapes, so specific embodiments are shown in the drawings and will be described in detail in this specification. However, it should be understood that the exemplary embodiments according to the concept of the present disclosure are not limited to the embodiments which will be described hereinbelow with reference to the accompanying drawings, but all of modifications, equivalents, and substitutions are included in the scope and spirit of the present disclosure.

It will be understood that, although the terms first, second, etc. may be used herein to describe various elements, but these elements should not be limited by these terms. These terms are only used to distinguish one element, from another element. For instance, a first element discussed below could be termed a second element without departing from the teachings of the present disclosure. Similarly, the second element could also be termed the first element.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween. Further, the terms used herein to describe a relationship between elements, that is, "between", "directly between", "adjacent" or "directly adjacent" should be interpreted in the same manner as those described above.

Terms used in the present disclosure are used only in order to describe specific exemplary embodiments rather than limiting the present disclosure. Singular forms are intended to include plural forms unless the context cleanly indicates otherwise. It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

Unless otherwise defined, all terms including technical and scientific terms used herein have the same meaning as commonly understood by those skilled in the art to which the present disclosure belongs. It must be understood that the terms defined by the dictionary are identical with the meanings within the context of the related art, and they should not be ideally or excessively formally defined unless the context cleanly dictates otherwise.

FIG. 1 is a view showing the configuration of an ice-separating control system of an ice maker according to the present disclosure.

Referring to the figure, first, an ice-making time counter 110 counts a consumed ice-making time in ice-making is performed. The consumed ice-making time may be time from the start of ice-making to the end of ice-making in one cycle.

An ice-separating setter 120 sets a target ice-separating time longer than a predetermined reference ice-separating time when the consumed ice-making time measured by the ice-making time counter 110 is out of a reference time range. The predetermined reference ice-separating time may be a common reference ice-separating time that is set when a consumed ice-making time is in a reference time range.

An operation controller 130 controls the ice maker to perform ice-separating for the set target ice-separating time. The target ice-separating time starts to be counted when the temperature of a refrigerant detected by a temperature sensor reaches a set value, and ice-separating is performed for the target ice-separating time.

The operation controller 130 controls the operation of values that actively operate in a path through which water and the refrigerant circulate in addition to a water pump and a compressor for ice-making and ice-separating.

That is, when the consumed ice-making time is relatively short, it is determined that the surrounding temperature is low, and the ice-separating time is set to be short. When the consumed ice-making time is relatively long, it is determined that excessive water is supplied to a water tank 10 due to breakdown such as clogging of an exhaust line 30 for discharging water from an overflow pipe 20, or unlocking of a water inlet valve, and the ice-separating time is set to be long.

Accordingly, when an ice-making time changes due to a change of the surrounding temperature or a mechanical problem in the ice maker, the ice-separating time is changed and applied in accordance with the changed ice-making time, whereby ice is cleanly separated and malfunction of the ice maker is prevented.

A method of controlling ice-separating using the ice-separating control system of the ice is described. The method includes: an ice-making time counting process of counting a consumed ice-making time when ice-making is performed, by means of a controller 100; an ice-separating time setting process of setting a target ice-separating time longer than a predetermined reference ice-separating time when the consumed ice-making time is out of a reference time range by means of the controller 100; and an ice-separating control process of controlling the ice maker to perform ice-separating for the set target ice-separating time by means of the controller 100.

For reference, the controller 100 according to exemplary embodiments of the present disclosure can be implemented through a nonvolatile memory (not shown) configured to store algorithms for controlling operation of various components of an ice maker machine or data about software commands for executing the algorithms, and a processor (not shown) configured to perform operation to be described below using the data stored in the memory. The memory and the processor may be individual chips. Alternatively, the memory and the processor may be integrated in a single chip. The processor may be implemented as one or more processors.

Figure 2:
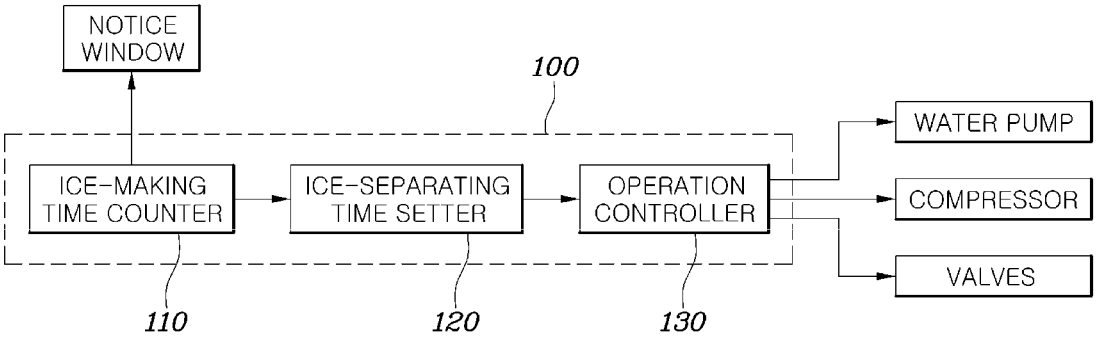
FIG. 2 is a view showing the configuration of an ice-separating control system according to the present disclosure.

FIG. 2 is a flowchart showing the entire ice-separating control process of the ice maker according to the present disclosure.

Referring to the figure, in the ice-making time counting process, the controller counts a consumed ice-making time in ice-making.

In a first ice-separating time setting process, the controller 100 sets the target ice-separating time as a first ice-separating time that is longer than the reference ice-separating time when the consumed ice-making time is less than a minimum reference time.

However, when the consumed ice-making time is in the reference time range, the target ice-separating time is set as the reference ice-separating time.

For example, when the reference time range for the consumed ice-making time is generally A~B (A<B), the reference ice-separating time is set as T2. However, when the consumed ice-making time is less than A, the reference ice-separating time is set as T1 that is longer than T2.

In the ice-separating control process, the controller 100 controls the ice maker to perform ice-separating for the set target ice-separating time.

For example, when the target ice-separating time is set as T1, ice-separating is performed for T1.

That is, when the consumed ice-making time is relatively short, it is determined that the consumed ice-making time became short due to a low temperature around the ice maker, and the ice-separating time set to be long in this case, whereby the ice-separating time is changed and applied in accordance with the changed ice-making time. Accordingly, ice is cleanly separated and accordingly malfunction of the ice maker is prevented.

Further, the method may further include a second ice-separating time setting process of setting the target ice-separating time as a second ice-separating time that is longer than the predetermined reference ice-separating time when the consumed ice-making time counted in the ice-making time counting process is a maximum reference time or more.

However, when the consumed ice-making time B or more, the reference ice-separating time is set as T1 that is longer than T2.

That is, when the consumed ice-making time is relatively long, it is determined that the consumed ice-making time was increased due to a mechanical problem in the ice maker (breakdown of the water inlet valve or clogging of the exhaust line 3), and the ice-separating time set to be long in this case, whereby the ice-separating time is changed and applied in accordance with the changed ice-making time. Accordingly, ice is cleanly separated and accordingly malfunction of the ice maker is prevented.

The first ice-separating time and the second ice-separating time may be set to be the same, but this is only an example, and the first ice-separating time and the second ice-separating time may be set to be different, depending on various variables such as the specification and use state of the ice maker, and the environment.

Referring to FIG. 2, when the case in which the consumed ice-making time is the maximum reference time or more occurs continuously two or more times, a malfunction signal of the ice maker may be output.

That is, an increase of the required ice-making time continuously occurs, the ice maker may be diagnosed as having a problem and a code or a notice about the malfunction may be generated though a notice window or a voice.

Figure 3:
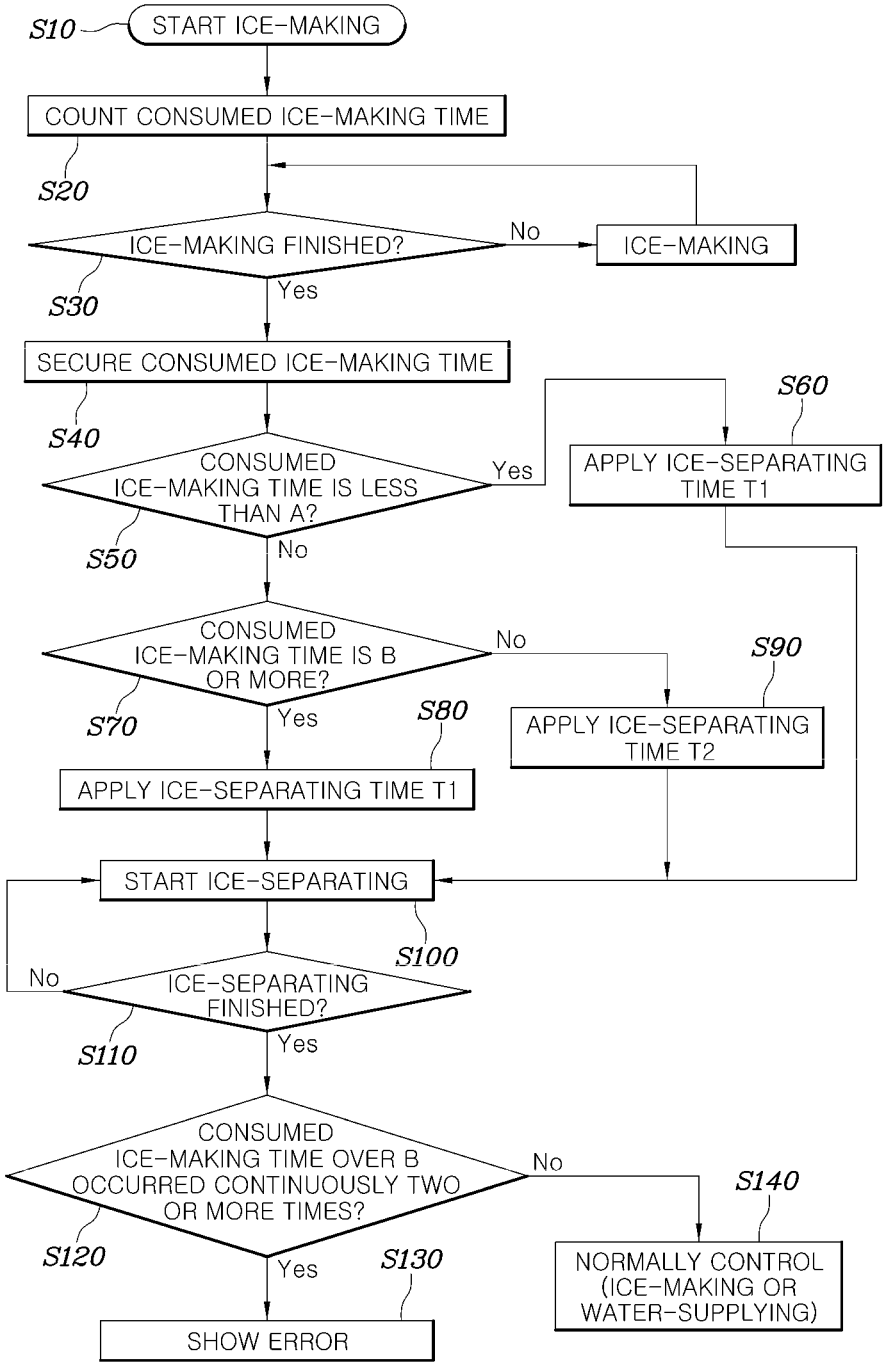
FIG. 3 is a flowchart showing the entire ice-separating control process of the ice maker according to the present disclosure.

Hereafter, the entire ice-separating control process according to the present disclosure is described through an example with reference to FIG. 3.

First, when the ice maker starts ice-making (S10), a consumed ice-making time starts to be counted (S20), whereby the consumed ice-making time until the ice-making is finished is counted.

Then, whether ice-making has been finished is monitored (S30), and when ice-making has been finished as the result of monitoring, the consumed ice-making time is secured (S40).

Next, whether the secured consumed ice-making time is less than A (20 minutes) is determined (S50).

When the consumed ice-making time is less than A as the result of determining in S50, a target ice-separating time is set as T1 (480 seconds) (S60) and ice-separating is performed for the set time T1 (S100).

However, when the consumed ice-making time is not less than A, whether it is B (60 minutes) or more is determined (S70).

When the consumed ice-making time is B or more as the result of determining in S70, a target ice-separating time is set as T1 (480 seconds) (S80) and ice-separating is performed for the set time T1 (S100).

However, when the consumed ice-making time is not B or more, the consumed ice-making time is A (20 minutes)~B (60 minutes), so the target ice-separating time is set as T2 (120 seconds) (S90) and ice-separating is performed for the set time T2 (S100).

Next, whether ice-separating has been finished is determined (S110), and when ice-separating has been finished, whether the case in which the consumed ice-making time is B or more has occurred continuously two or more times is determined (S120).

When the case occurs continuously two or more times, the ice maker is warned of an error (S130), but when the case does not occur continuously two or more times, ice-making or water-supplying is normally performed for ice-making in the next cycle (S140).

According to the present disclosure, as described above, when the consumed ice-making time is relatively short or long, the ice-separating time is changed to be long in accordance with the changed consumed ice-making time, whereby ice is cleanly separated and malfunction of the ice maker is prevented.

On the other hand, although the present disclosure was described with reference to the detailed embodiments, it is apparent to those skilled in the art that the present disclosure may be changed and modified in various ways without the scope of the present disclosure and it should be noted that the changes and modifications are included in claims.

The invention claimed is:

1. A system for controlling ice-making and ice-separating of an ice maker, the system comprising:

an ice-making time counter counting a consumed ice-making time when ice-making is performed;

an ice-separating time setter setting a target ice-separating time longer than a predetermined reference ice-separating time when the consumed ice-making time is out of a reference time range; and an operation controller controlling the ice maker to perform ice-separating for the set target ice-separating time.

2. A system for controlling ice-making and ice-separating of an ice maker, the system comprising:

an ice-making time counter counting a consumed ice-making time when ice-making is performed;

an ice-separating time setter setting a target ice-separating time as a first ice-separating time that is longer than a predetermined reference ice-separating time when the consumed ice-making time is less than a minimum reference time; and an operation controller controlling the ice maker to perform ice-separating for the set target ice-separating time.

3. The system of claim 2, wherein the ice-separating time setter sets the target ice-separating time as a second ice-separating time that is longer than the predetermined reference ice-separating time when the consumed ice-making time is a maximum reference time or more.

4. The system of claim 3, wherein the first ice-separating time and the second ice-separating time are the same.

5. The system of claim 3, wherein when a case in which the consumed ice-making time is the maximum reference time or more occurs continuously two or more times, a malfunction signal of the ice maker is output.

6. The system of claim 2, wherein when the consumed ice-making time is in the reference time range, the target ice-separating time is set as the reference ice-separating time.

* * * * *